US006162100A

United States Patent [19]

Al-Turki

[11] Patent Number: 6,162,100

[45] Date of Patent: Dec. 19, 2000

[54] ADAPTER FOR EDISON/BAYONET LIGHT SOCKETS

[76] Inventor: Ali Al-Turki, Al-Khaledyah, Block 2, Str 24, House #7, State of Kuwait, Kuwait

[21] Appl. No.: 09/084,300

[22] Filed: May 26, 1998

[51] Int. Cl.[7] ..... H01R 25/00

[52] U.S. Cl. ..... 439/644; 439/641; 439/642; 439/649

[58] Field of Search ..... 434/641, 644, 434/649, 639; 362/228, 249; D26/24, 26, 34, 37, 68, 69, 80, 106

[56] References Cited

U.S. PATENT DOCUMENTS

| | | | |
|---|---|---|---|
| 1,172,953 | 2/1916 | Dempster | 336/107 |
| 1,640,434 | 8/1927 | Weston | 439/644 |
| 3,137,448 | 6/1964 | Holzhause | 439/639 |
| 4,936,789 | 6/1990 | Ugalde | 439/236 |
| 5,320,548 | 6/1994 | Schadhauser | 439/236 |

FOREIGN PATENT DOCUMENTS

| | | | |
|---|---|---|---|
| 2561044 | 9/1985 | France | 439/642 |
| 2817122 | 10/1979 | Germany | 439/642 |

*Primary Examiner*—Neil Abrams
*Assistant Examiner*—Javaid Nasri
*Attorney, Agent, or Firm*—Michael I. Kroll

[57] ABSTRACT

A power level adapter for connecting a low power light bulb within a higher power socket. The power level adapter includes a collar and a skirt depending from the collar. The skirt includes an outer side having a circumference substantially equal to a circumference of the socket and an inner side extending through said collar and forming a bulb receiving pool having a circumference substantially equal to a circumference of the light bulb. A device for releasably connecting the outer side within the socket is positioned on the outer side and a device for releasably retaining the light bulb within said pool is positioned within the bulb receiving pool. A electrically conductive wire-extends through the skirt for electrically connecting the light bulb to the socket type bulb. The device for releasably retaining the light bulb within said pool is able to receive one of an Edison or Bayonet type bulb and the device for releasably retaining the outer side within the socket is able to be received by one of an Edison or Bayonet type socket. The circumference of the inner side is smaller than the circumference of the outer side allowing connection of an electrical socket with a lower power light bulb.

1 Claim, 11 Drawing Sheets

ADAPTER FOR EDISON/BAYONET LIGHT SOCKETS

BACKGROUND OF THE INVENTION

1. Field of the Invention

The present invention relates generally to adapters for lighting fixtures and, more specifically, to a power level adapter allowing use of a low power light bulb in a fixture having a socket designed to receive high power light bulbs.

2. Description of the Prior Art

Numerous light bulb socket adapters which allow for the installation of candelabra or low power type light bulbs have been provided in the prior art. For example, U.S. Pat. Nos, 1,172,953; 1,640,434; 4,936,789 and 5,320,548 all are illustrative of such prior art. While these light bulb adapters may be suitable for the particular purpose to which they address, they would not be as suitable for the purposes of the present invention as heretofore described. It is thus desirable to provide a light bulb adapter having its electrically conductive contacts at a base thereof for mating with the electrically conductive contacts of the socket in which it is placed. It is further desirable to provide a light bulb adapter having a nonconductive external material including a collar for easily and safely installing and positioning the light bulb adapter in the proper position.

This invention relates to adapters for enabling an electric lamp or the like to be operated at its rated or any desired voltage in a socket or receptacle between whose terminals some different voltage prevails. This device combines in a simple, compact, convenient, unitary structure a base or plug device or element for the aforesaid socket; a socket or receptacle for the lamp and means such as a transformer for producing the desired voltage between the terminals or contacts of said latter socket.

The present invention relates to holders for incandescent electric lamps and more especially to devices for adapting holders designed to receive and function with one type of lamp base to the reception and operation with lamps having a different type of base and commercially known as socket adapters. This invention provides a socket adapter whereby a lamp with an Edison type of base may be readily connected in operative relation to a standard Edison socket, which shall be strong, compact and of low manufacturing cost and which will insure accurate positioning of the lamp relative to the socket.

An adapter includes a threaded portion intended to be screwed into a conventional lamp socket to replace a standard incandescent light bulb. The adapter includes spring clips that are operative to prevent removal of terminal pins on the base of a fluorescent lamp. A table lamp in which the adapter is installed is connected through a male polarized electrical plug to a remote power supply. The power supply is plugged into a conventional AC wall outlet. A tamper-proof fastener attaches the power supply to the outlet, preventing it from being removed by a user who does not have access to a special driver required to turn the fastener. Spring clips within the power supply prevent removal of the male plug, so that the table lamp cannot be stolen without cutting the power cord.

To permit use of a compact fluorescent lamp having a base with projecting terminal pins in an ordinary standard Edison light bulb socket, an adapter has a light bulb thread and the housing body includes a reception well to receive a locating plate or plug from the lamp. To relieve stresses and strains on reception terminals which are electrically connected to a printed circuit board within the adapter body, the reception terminals, and preferably the connecting lugs thereof, are formed with openings which are engaged by matching projections formed on the housing body, and preferably by projections extending from the wall defining the well which receives the locating plate or lug of the lamp. This avoids bending, and hence damage to the printed circuit board upon insertion of the lamp pins in the spring contact portions of the reception terminals since assembly stresses are accepted by the housing body and not by the printed circuit board.

SUMMARY OF THE PRESENT INVENTION

The present invention relates generally to adapters for lighting fixtures and, more specifically, to a power level adapter allowing use of a low power light bulb in a fixture having a socket designed to receive high power light bulbs.

A primary object of the present invention is to provide a power level adapter for high power level electrical lighting fixtures that will overcome the shortcomings of prior art devices.

Another object of the present invention is to provide a power level adapter for high power level electrical lighting fixtures which allows use of a low power light bulb in a fixture designed to receive higher power light bulbs.

A further object of the present invention is to provide a power level adapter for high power level electrical lighting fixtures including a nonconductive collar allowing gripping of the adapter for installation and removal of the electrical lamp lighting fixture bulb adapter.

An additional object of the present invention is to provide a power level adapter for high power level electrical lighting fixtures including electrically conductive contact points for mating with the electrically conductive contacts within the socket of the fixture.

A still further object of the present invention is to provide a power level adapter for high power level electrical lighting fixtures including a substantially nonconductive exterior surface for protecting a user from defective sockets and inadvertent contact with any electrically conductive components of the socket and/or adapter.

A yet further object of the present invention is to provide a power level adapter for high power level electrical lighting fixtures substantially contained within the socket of the fixture by which it is received thereby providing an ergonomically functional adapter for use in highly visible locations.

An even further object of the present invention is to provide a power level adapter for high power level electrical lighting fixtures able to effectively reduce the circumference of the socket for receiving lower power light bulbs having a base of a circumference smaller than that of the socket.

A still further object of the present invention is to provide a power level adapter for high power level electrical lighting fixtures allowing installation of a candelabra type light bulb having an Edison type base into a standard Edison type base.

An even further object of the present invention is to provide a power level adapter for high power level electrical lighting fixtures allowing installation of a candelabra type light bulb having a Bayonet type base into a standard Edison type socket.

Another object of the present invention is to provide a power level adapter for high power level electrical lighting fixtures allowing installation of a candelabra type light bulb having an Edison type base into a standard Bayonet type socket base.

A still further object of the present invention is to provide a power level adapter for high power level electrical lighting fixtures allowing installation of a candelabra type light bulb having a Bayonet type base into a standard Bayonet type socket.

A yet further object of the present invention is to provide a power level adapter for high power level electrical lighting fixtures allowing the use of smaller wattage bulbs with a high wattage fixture thereby reducing energy needs.

A still further object of the present invention is to provide a power level adapter for high power level electrical lighting fixtures allowing the permanent use of smaller wattage bulbs with a high wattage fixture thereby reducing energy costs.

Another object of the present invention is to provide a power level adapter for high power level electrical lighting fixtures that is simple and easy to use.

A still further object of the present invention is to provide a power level adapter for high power level electrical lighting fixtures that is economical in cost to manufacture.

Additional objects of the present invention will appear as the description proceeds.

A power level adapter for connecting a low power light bulb within a higher power socket is disclosed by the present invention. The power level adapter includes a collar and a skirt depending from the collar. The skirt includes an outer side having a circumference substantially equal to a circumference of the socket and an inner side extending through said collar and forming a bulb receiving pool having a circumference substantially equal to a circumference of the light bulb. A device for releasably connecting the outer side within the socket is positioned on the outer side and a device for releasably retaining the light bulb within said pool is positioned within the bulb receiving pool. A electrically conductive wire extends through the skirt for electrically connecting the light bulb to the socket type bulb. The device for releasably retaining the light bulb within said pool is able to receive one of an Edison or Bayonet type bulb and the device for releasably retaining the outer side within the socket is able to be received by one of an Edison or Bayonet type socket. The circumference of the inner side is smaller than the circumference of the outer side allowing connection of an electrical socket with a lower power light bulb.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views.

DESCRIPTION OF THE REFERENCED NUMERALS

Figure 1:
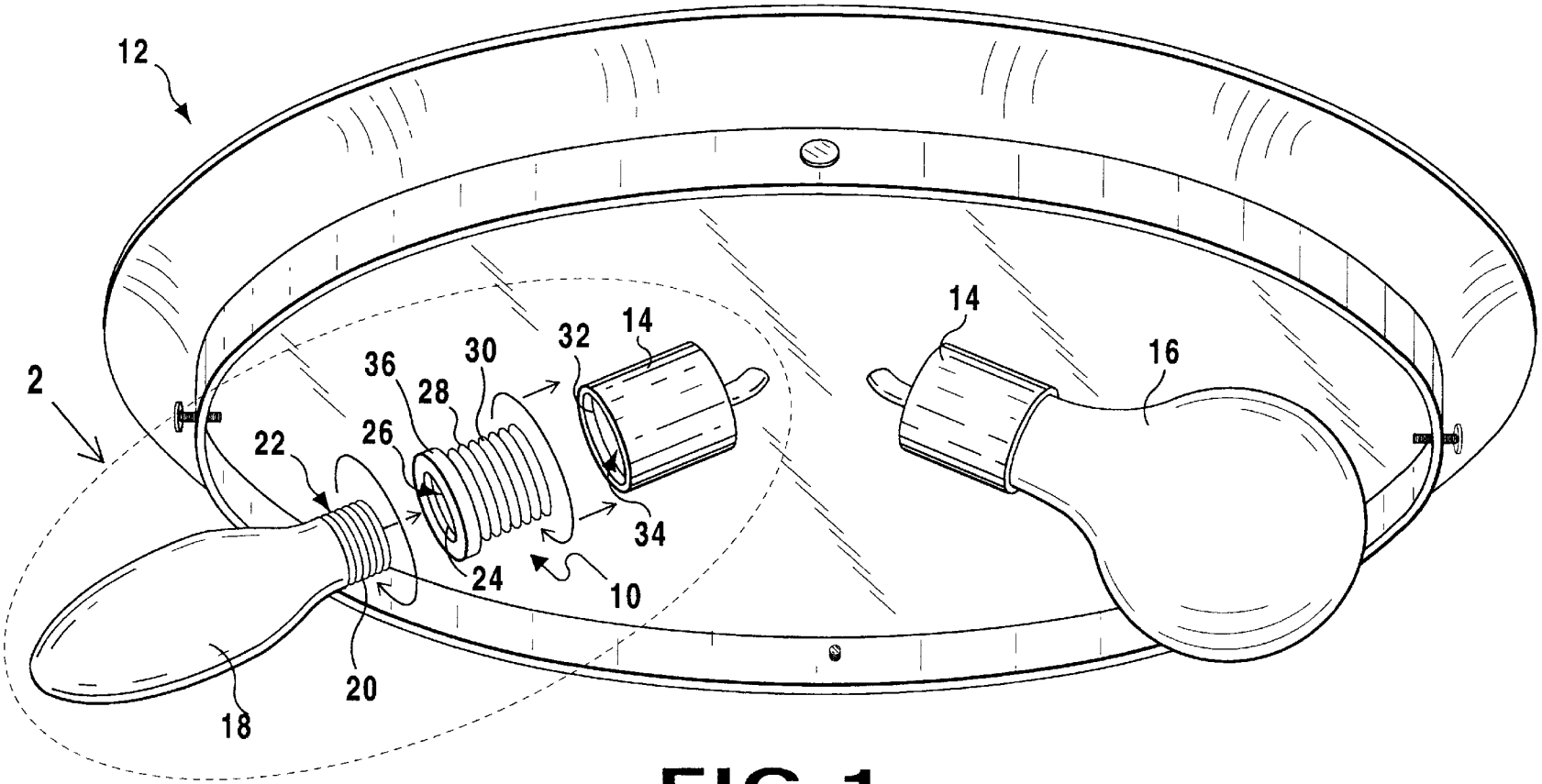
FIG. 1 is a perspective view of a conventional electrical light fixture containing two Edison type sockets, a first socket including a normal power light bulb and the second socket including the power level adapter for high power level electrical lighting fixtures of the present invention for accommodating a smaller Edison type light bulb.

Turning now descriptively to the drawings, in which similar reference characters denote similar elements throughout the several views, the Figures illustrate the power level adapter for high power level electrical lighting fixtures of the present invention. With regard to the reference numerals used, the following numbering is used throughout the various drawing figures.

10 power level adapter for high power level electrical lamp lighting fixture of the present invention 12 lighting fixture 14 conventional Edison type socket 16 conventional light bulb for use in Edison type socket 18 low power Edison type light bulb to be received by power level adapter for high power level electrical lamp lighting fixture of the present invention 20 thread spiraling around base portion of low power Edison type light bulb
22 base side of Edison type light bulb
24 thread spiraling around inner side of power level adapter for high power level electrical lamp lighting fixture
26 inner side of power level adapter for high power level electrical lamp lighting fixture
28 thread spiraling around outer side of power level adapter for high power level electrical lamp lighting fixture
30 outer side of power level adapter for high power level electrical lamp
32 thread spiraling around base portion of Edison type socket
34 inner side of Edison type socket
36 collar on power level adapter for high power level electrical lamp
38 arrow indicating direction to turn low power Edison type bulb for connection with power level adapter for high power level electrical lamp
40 arrow indication direction of force applied to low power Edison type bulb for connection with power level adapter for high power level electrical lamp
42 arrow indicating direction to turn power level adapter for high power level electrical lamp for connection with Edison type socket
44 arrow indication direction of force applied to power level adapter for high power level electrical lamp for connection with Edison type socket
46 second embodiment of the power level adapter for high power level electrical lamp lighting fixture
48 bayonet type light bulb
50 base portion of bayonet type light bulb
52 bulb portion of bayonet type light bulb
54 pins extending from base of bayonet type light bulb
56 contact terminals on bayonet type light bulb
58 underside of bayonet type light bulb
60 nonconductive collar
62 skirt
64 pair of pin receiving L-shaped recesses
66 inner side of the skirt
68 outer side of the skirt
70 thread spiraling around outer side of skirt
72 arrows indicating direction of force applied to Bayonet type bulb for insertion into second embodiment
74 arrows indication direction of rotation of Bayonet type bulb for insertion into second embodiment
76 arrows indicating direction of rotation applied to second embodiment for connection with Edison type socket
78 arrows indicating direction of force applied to second embodiment for connection with Edison type socket
80 third embodiment of the power level adapter for high power level electrical lamp lighting fixture
82 bayonet type socket
84 thread spiraling around inner side of third embodiment
86 inner side of third embodiment
88 outer side
90 pair of pins extending from outer side
92 underside of third embodiment
94 arrows indicating direction of rotation applied to Edison type bulb for connection with third embodiment
96 arrows indicating direction of force applied to Edison type bulb for connection with third embodiment
98 arrows indicating direction of force applied to third embodiment for connection with Bayonet type socket
100 arrows indication direction of rotation applied to third embodiment for connection with Bayonet type socket
102 pin receiving recesses in skirt of bayonet type socket
104 horizontal portion of L-shaped recesses
106 fourth embodiment of the power level adapter for high power level electrical lamp lighting fixture
108 nonconductive collar
110 skirt extending from collar
112 pair of pin receiving L-shaped recesses
114 inner side
116 pair of pins extending from outer side
118 underside of fourth embodiment
120 arrows indicating direction of force applied to Bayonet type bulb for insertion into fourth embodiment
122 arrows indication direction of rotation of Bayonet type bulb for insertion into fourth embodiment
124 arrows indicating direction of force applied to fourth embodiment for connection with Bayonet type socket
126 arrows indication direction of rotation applied to fourth embodiment for connection with Bayonet type socket
128 skirt
130 first coupling wire
132 contact terminal on base side
134 base side
136 second coupling wire
138 base side
140 first contact terminal
142 second contact terminal
144 third contact terminal
146 base side of the skirt
148 first electrically conductive coupling wire
150 second electrically conductive coupling wire
152 first contact terminal
154 second contact terminal
156 first electrically conductive coupling wire
158 second electrically conductive coupling wire
160 outer side
162 first contact terminal
164 second contact terminal
166 third contact terminal
168 fourth contact terminal
170 first electrically conductive coupling wire
172 second electrically conductive coupling wire
174 inner side of Edison type socket
176 ground wire
178 pole
180 source of positive voltage
182 first contact terminal of Bayonet type socket
184 ground wire
186 second contact terminal
188 voltage supply

DETAILED DESCRIPTION OF THE PREFERRED EMBODIMENT

Turning now descriptively to the drawings, in which similar reference characters denote similar elements throughout the several views, FIG. 1 illustrates a first embodiment of the power level adapter for high power level electrical lamp lighting fixtures of the present invention indicated generally by the numeral 10. The power level adapter 10 is used in a conventional lighting fixture 12. The illustrated lighting fixture 12 includes two Edison type sockets 14. Positioned in one of the Edison type sockets 14 is a conventional Edison type light bulb 16. The power level adapter 10 is received by the other Edison type socket 14, for connecting a lower power Edison type light bulb 18 therein.

The lower power Edison type light bulb 18 is a conventional Edison type light bulb and includes a thread 20 spiraling around a base 22 thereof. Generally, the base of the lower power light bulbs have a circumference smaller than the circumference of the higher power socket and thus are unable to be retained thereby. The thread 20 spiraling around the base 22 of the Edison type bulb 18 mates with a thread 24 spiraling around an inner side 26 of the power level adapter 10 and is retained therein. The inner side 26 of the power level adapter 10 has a circumference substantially matching the circumference of the base of the lower power light bulb 18 and thus can receive and hold the light bulb 18 therein. A thread 28 spirals around an outer side 30 of the power level adapter 10 for mating with a thread 32 spiraling around an inner side 34 of the Edison type socket 14. The circumference of the outer side 30 of the power level adapter 10 substantially matches that of the inner side 34 of the socket 14 and thus can be received therein.

The power level adapter 10 includes a conductive path extending therethrough for connecting the electrically conductive contact of the socket with the electrically conductive contacts of the Edison type bulb 18 as will be discussed with specific reference to FIGS. 6 and 10. Thus, when the power level adapter 10 is received by the Edison type socket 14, electrically conductive contacts within the Edison type socket 14 are caused to contact electrically conductive contacts on the low power Edison type light bulb 16 providing a flow of current thereto and allowing illumination of the Edison type light bulb 16 as will be explained hereinafter. The power level adapter 10 also includes a nonconductive collar 36 extending around one side thereof for grasping by a user when installing or removing the power level adapter 10 from the socket 14.

Figure 2:
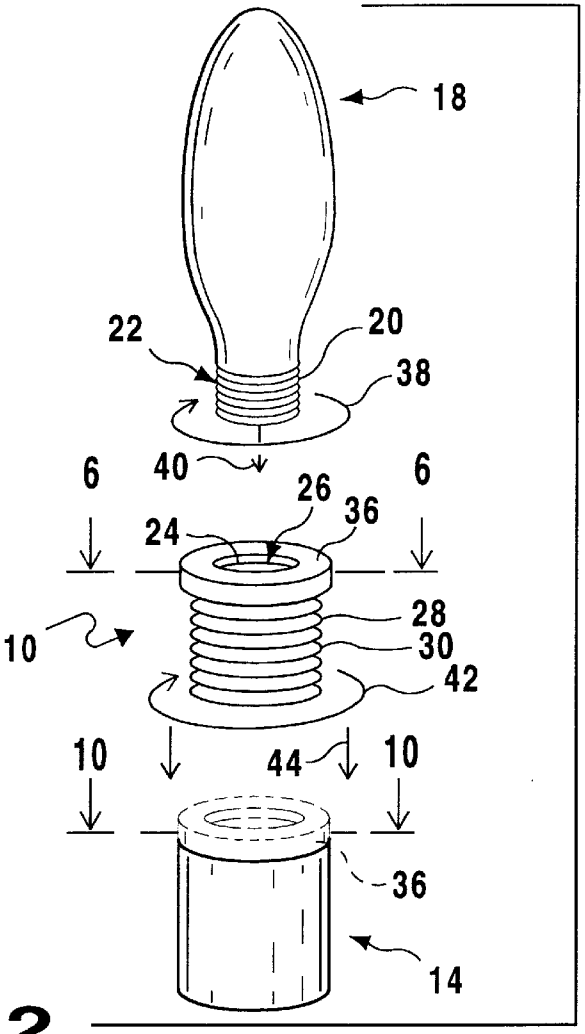
FIG. 2 is an exploded front perspective view taken from within the circle labeled 2 of FIG. 1 illustrating use of the power level adapter for high power level electrical lighting fixtures of the present invention for installation of a smaller Edison type light bulb into a larger Edison type socket.

FIG. 2 is an exploded view of the low power Edison type light bulb 18, power level adapter 10 and Edison type socket 14 shown within in the circle labeled 2 of FIG. 1. As can be seen from this figure and as illustrated, the low power Edison type light bulb 18 must be turned in a clockwise direction as indicated by the arrow labeled 38 while applying a force towards the thread 24 spiraling within the inner side 26 of the power level adapter 10 as indicated by the arrow labeled 40 to insert the low power Edison type light bulb 18 into the power level adapter 10. This will cause the thread 20 on the base 22 of the low voltage Edison type bulb 18 to mate with the thread 24 on the inner side 26 of the power level adapter 10 and thereby be received and held within the power level adapter 10.

In order to connect the power level adapter 10 to the Edison type socket 14, the power level adapter 10 must be turned in a clockwise direction as indicated by the arrow labeled 42 while applying a force towards the power level adapter 10 as indicated by the arrow labeled 44. This will cause the thread 28 on the outer side 30 of the power level adapter 10 to mate with the thread 32 within the Edison type socket 14. The power level adapter 10 is thus releasably received within the Edison type socket 14. The electrically conductive contacts of the socket 14 are also connected with the electrically conductive contacts of the Edison type bulb 18 via the conductive path extending through the power level adapter 10.

Figure 3:
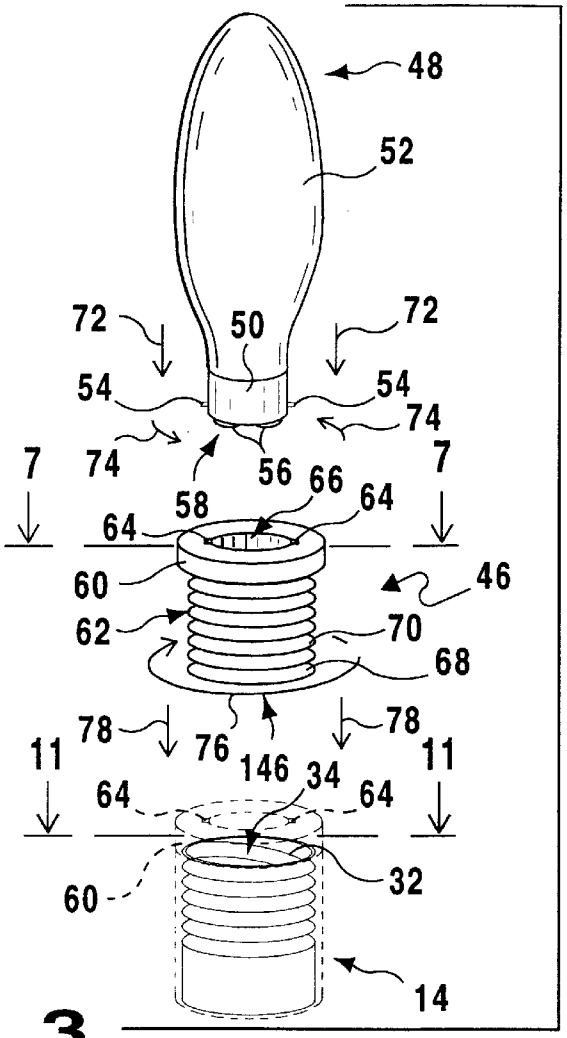
FIG. 3 is an exploded front perspective view illustrating use of the power level adapter for high power level electrical lighting fixtures of the present invention for installation of a smaller Bayonet type light bulb into a larger Edison type socket.

FIG. 3 illustrates a second embodiment of the power level adapter for high power level electrical lamp lighting fixtures 46 of the present invention for connecting a low power Bayonet type light bulb 48 within an Edison type socket 14. A conventional Bayonet type bulb 48 includes a base portion 50 extending from a bulb portion 52 thereof. The base portion 50 includes a pair of pins 54 extending therefrom and a pair of contact terminals 56 extending from an underside 58 thereof.

The power level adapter 46 includes a nonconductive collar 60 having a skirt 62 extending therefrom to form a bulb receiving pool. A pair of pin receiving L-shaped recesses 64 extend through opposing sides of the collar 60 and along a length of an inner side 66 of the skirt as will be described hereinafter with specific reference to FIGS. 7 and 11. Each recess 64 is positioned to receive a respective one of the pair of pins 54 extending from the base portion 50 of the bayonet type light bulb 48. The circumference of the inner side of the power level adapter 46 substantially matches that of the low power light bulb 48 and thus is able to receive and hold the light bulb 48 therein. An outer side 68 of the skirt 62 includes a thread 70 spiraling therearound for mating with the thread 32 on the inner side 34 of the Edison type socket 14. The circumference of the outer side 68 of the power level adapter 46 is substantially equal to that of the socket 14 and thus can be releasably positioned and held therein. The power level adapter 46 also includes a conductive path extending therethrough for connecting the electrically conductive contact of the socket 14 with the electrically conductive contacts of the Bayonet type bulb 48 as will be discussed with specific reference to FIGS. 7 and 11.

In order to connect the bayonet type light bulb 48 to the power level adapter 46 a force is applied to the bayonet type light bulb 48 in the direction of the arrows labeled 72. This causes the base portion 50 of the bayonet type light bulb 48 to be completely inserted into the bulb receiving pool whereby the pair of pins 54 are received by their respective L-shaped recess 64. The bayonet type light bulb 48 is then turned in a counterclockwise direction as illustrated by the arrows labeled 74 causing the pair of pins 54 to be seated in a horizontal portion of their respective L-shaped recess 64 and the pair of contact terminals 56 on the underside 58 of the base portion 50 of the bayonet type light bulb 48 to form an electrical contact with a pair of contacts within the bulb receiving pool to complete the circuit as will be discussed hereinafter with specific reference to FIGS. 7 and 11.

In order to connect the second embodiment of the power level adapter 46 to the Edison type socket 14, the power level adapter 46 must be turned in a clockwise direction as indicated by the arrow labeled 76 while applying a force towards the socket 14 as indicated by the arrow labeled 78. This will cause the thread 70 on the outer side 68 of the power level adapter 46 to mate with the thread 32 within the Edison type socket 14. The power level adapter 46 is thus releasably received within the Edison type socket 14.

Figure 4:
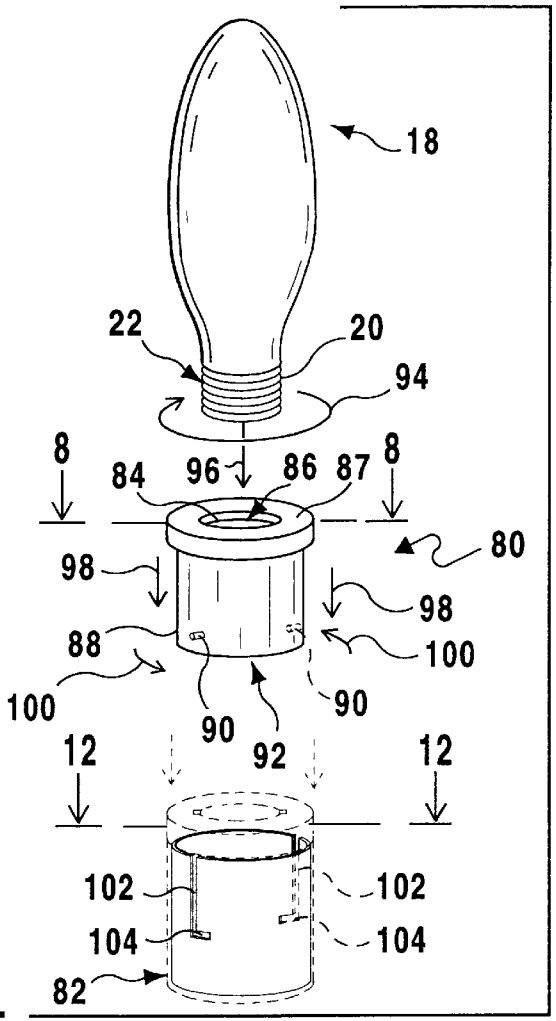
FIG. 4 is an exploded front perspective view illustrating use of the power level adapter for high power level electrical lighting fixtures of the present invention for installation of a smaller Edison type light bulb into a larger Bayonet type socket.
Figure 8:
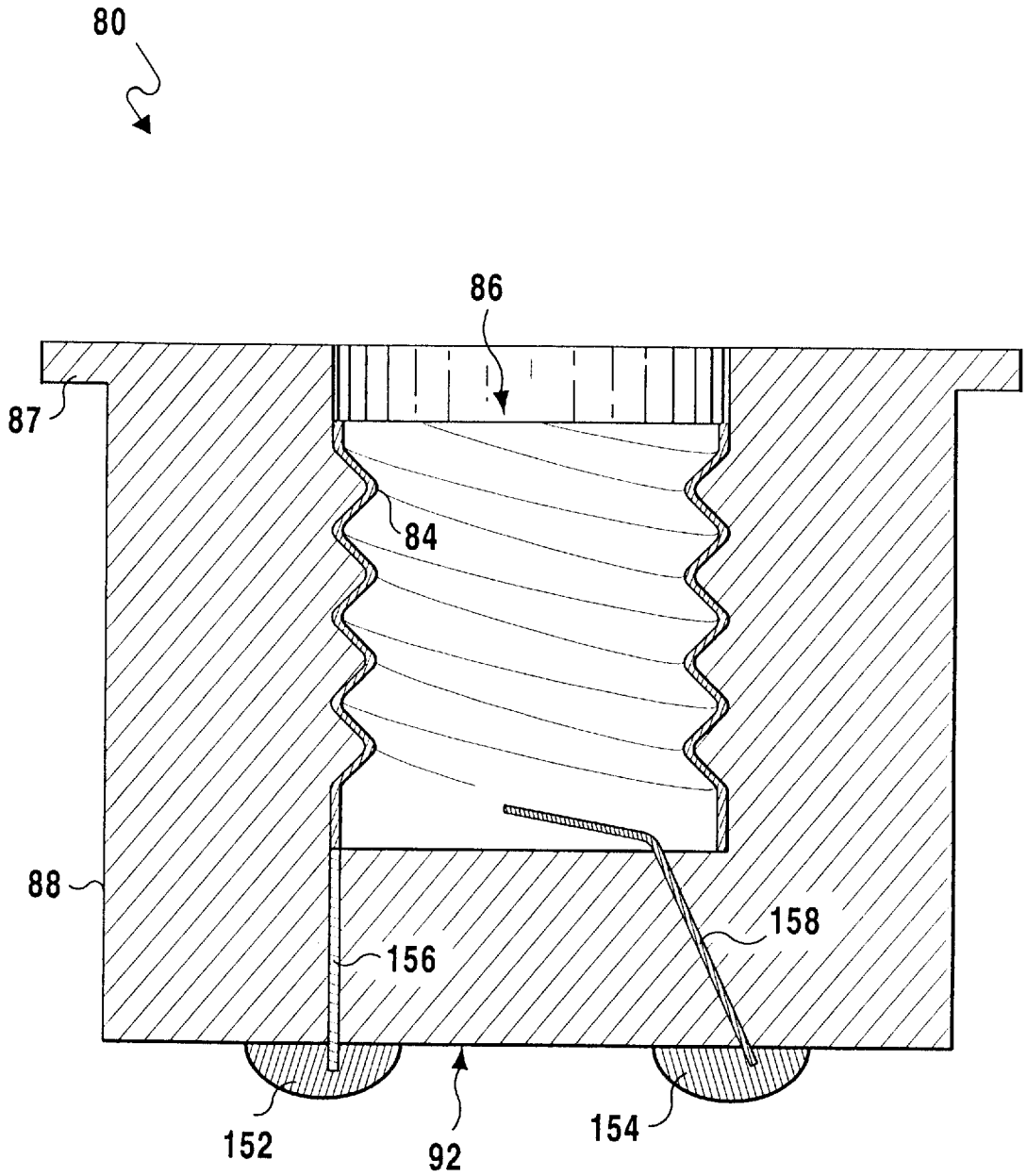
FIG. 8 is a cross-sectional view of the power level adapter for high power level electrical lighting fixtures of the present invention taken along the line 8—8 of FIG. 4.
Figure 12:
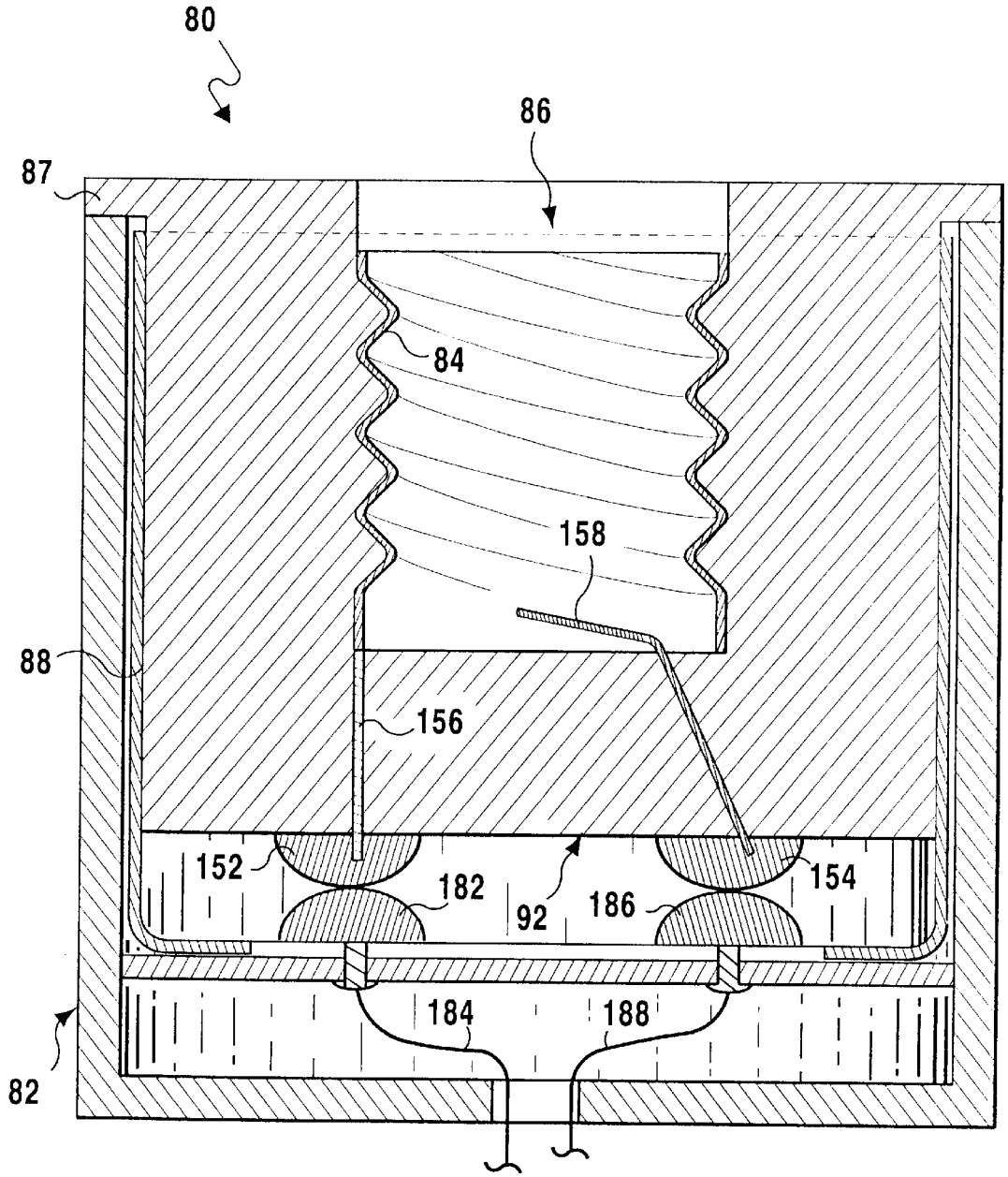
FIG. 12 is a cross-sectional view of the power level adapter for high power level electrical lighting fixtures of the present invention and socket taken along the line 12—12 of FIG. 4.

FIG. 4 illustrates a third embodiment of the power level adapter for high power level electrical lamp lighting fixtures 80 for connecting a low power Edison type light bulb 18 with a bayonet type socket 82. The third embodiment of the power level adapter 80 includes a thread 84 spiraling around an inner side 86 thereof for mating with the thread 20 on the outer side 22 of the low power Edison type light bulb 18. The circumference of the base of the light bulb 18 substantially matches the circumference of the inner side 86 of the power level adapter 80 and thus can be releasably held therein. An outer side 88 of the power level adapter 80 includes a pair of pins 90 extending therefrom and a pair of contact terminals as illustrated in FIGS. 8 and 12 extending from an underside 92 thereof. The circumference of the skirt 88 of the power level adapter 80 is substantially equal to the circumference of the socket 82 and thus can be releasably held therein. The power level adapter 80 also includes a conductive path extending therethrough for connecting the electrically conductive contact of the socket with the electrically conductive contacts of the Edison type bulb 18 as will be discussed with specific reference to FIGS. 8 and 12.

As can be seen from this figure and as illustrated, to insert the low power Edison type light bulb 18 into the power level adapter 80 the low power Edison type light bulb 18 must be turned in a clockwise direction as indicated by the arrow labeled 94 while applying a force towards the thread 84 spiraling within the inner side 86 of the power level adapter 80 as indicated by the arrow labeled 96. This will cause the thread 20 on the base 22 of the low voltage Edison type bulb 18 to mate with the thread 84 on the inner side 86 of the power level adapter 80 and thereby be received within the power level adapter 80.

In order to connect the power level adapter 80 to the bayonet type socket 82 a force is applied to the power level adapter 80 in the direction of the arrows labeled 98. This causes the base portion 50 of the power level adapter 80 to be completely inserted into the bulb receiving pool whereby the pair of pins 90 are received by respective L-shaped recesses 102 in the bayonet type socket 82. The power level adapter 80 is then turned in a counterclockwise direction as illustrated by the arrows labeled 100 causing the pair of pins 90 to be seated in a horizontal portion 104 of their respective L-shaped recess 102 and a pair of contact terminals on the underside 92 of the power level adapter 80 to contact a pair of contacts within the bulb receiving pool to complete the circuit as will be discussed hereinafter with specific reference to FIGS. 8 and 12.

Figure 5:
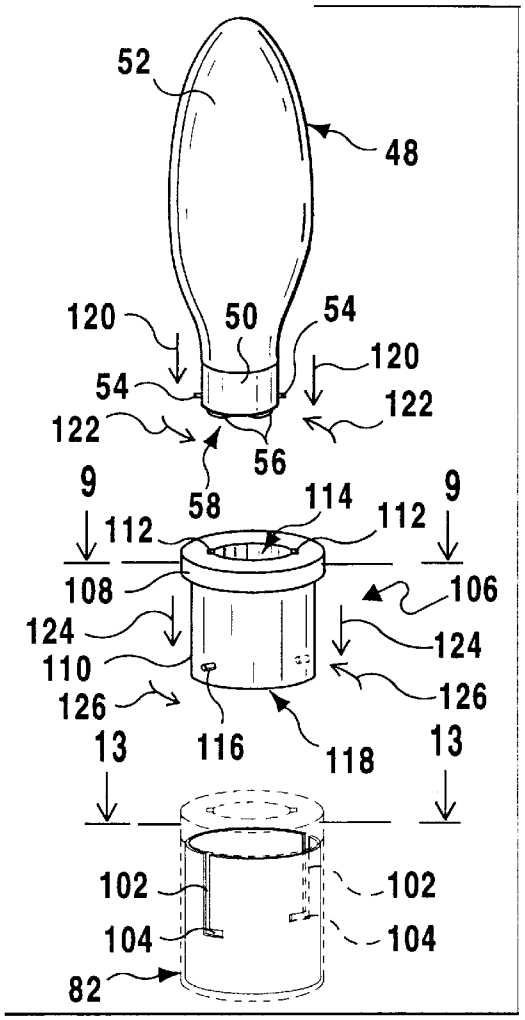
FIG. 5 is an exploded front perspective view illustrating use of the power level adapter for high power level electrical lighting fixtures of the present invention for installation of a smaller Bayonet type light bulb into a larger Bayonet type socket.

FIG. 5 illustrates a fourth embodiment of the power level adapter for high power level electrical lamp lighting fixtures 106 of the present invention for connecting a low power Bayonet type light bulb 48 to a high power Bayonet type socket 82. The power level adapter 106 includes a nonconductive collar 108 having a skirt 110 extending therefrom to form a bulb receiving pool. A pair of pin receiving L-shaped recesses 112 extend along opposing inner sides of the collar 108 and along a length of an inner side 114 of the skirt 110 as will be described with specific reference to FIGS. 9 and 13. The circumference of the inner side 114 of the skirt 110 is substantially equal to the circumference of the base of the light bulb 48 and thus can releasably hold the light bulb 48 therein. Each recess 112 is positioned to receive a respective one of the pair of pins 54 extending from the base portion 50 of the bayonet type light bulb 48. An outer side of the skirt 110 includes a pair of pins 116 extending therefrom and a pair of contact terminals extending from an underside 118 thereof. The circumference of the skirt 110 of the power level adapter 106 substantially matches the circumference of the socket 82 and thus can be releasably held therein. The power level adapter 106 also includes a conductive path extending therethrough for connecting the electrically conductive contact of the socket with the electrically conductive contacts of the Bayonet type bulb as will be discussed hereinafter with specific reference to FIGS. 9 and 13.

In order to connect the bayonet type light bulb 48 to the power level adapter 106 a force is applied to the bayonet type light bulb 48 in the direction of the arrows labeled 120. This causes the base portion 50 of the bayonet type light bulb 48 to be completely inserted into the bulb receiving pool whereby the pair of pins 54 are received by their respective L-shaped recess 112. The bayonet type light bulb 48 is then turned in a counterclockwise direction as illustrated by the arrows labeled 122 causing the pair of pins 54 to be seated in a horizontal portion of their respective L-shaped recess and the pair of contact terminals 56 on the underside 58 of the base portion 50 of the bayonet type light bulb 48 to contact with a pair of contacts within the bulb receiving pool as will be discussed hereinafter with specific reference to FIGS. 9 and 13.

In order to connect the power level adapter 106 to the bayonet type socket 82 a force is applied to the power level adapter 106 in the direction of the arrows labeled 124, the skirt 110 of the power level adapter 106 is caused to be completely inserted into the bulb receiving pool whereby the pair of pins 116 are received by respective L-shaped recesses 102 in the bayonet type socket 82. The power level adapter 106 is then turned in a counterclockwise direction as illustrated by the arrows labeled 126 causing the pair of pins 116 to be seated in a horizontal portion 104 of their respective L-shaped recess 102 and a pair of contact terminals on the underside 118 of the power level adapter 106 to contact with a pair of contacts within the bulb receiving pool to complete the circuit as will be discussed with specific reference to FIGS. 9 and 13.

Figure 6:
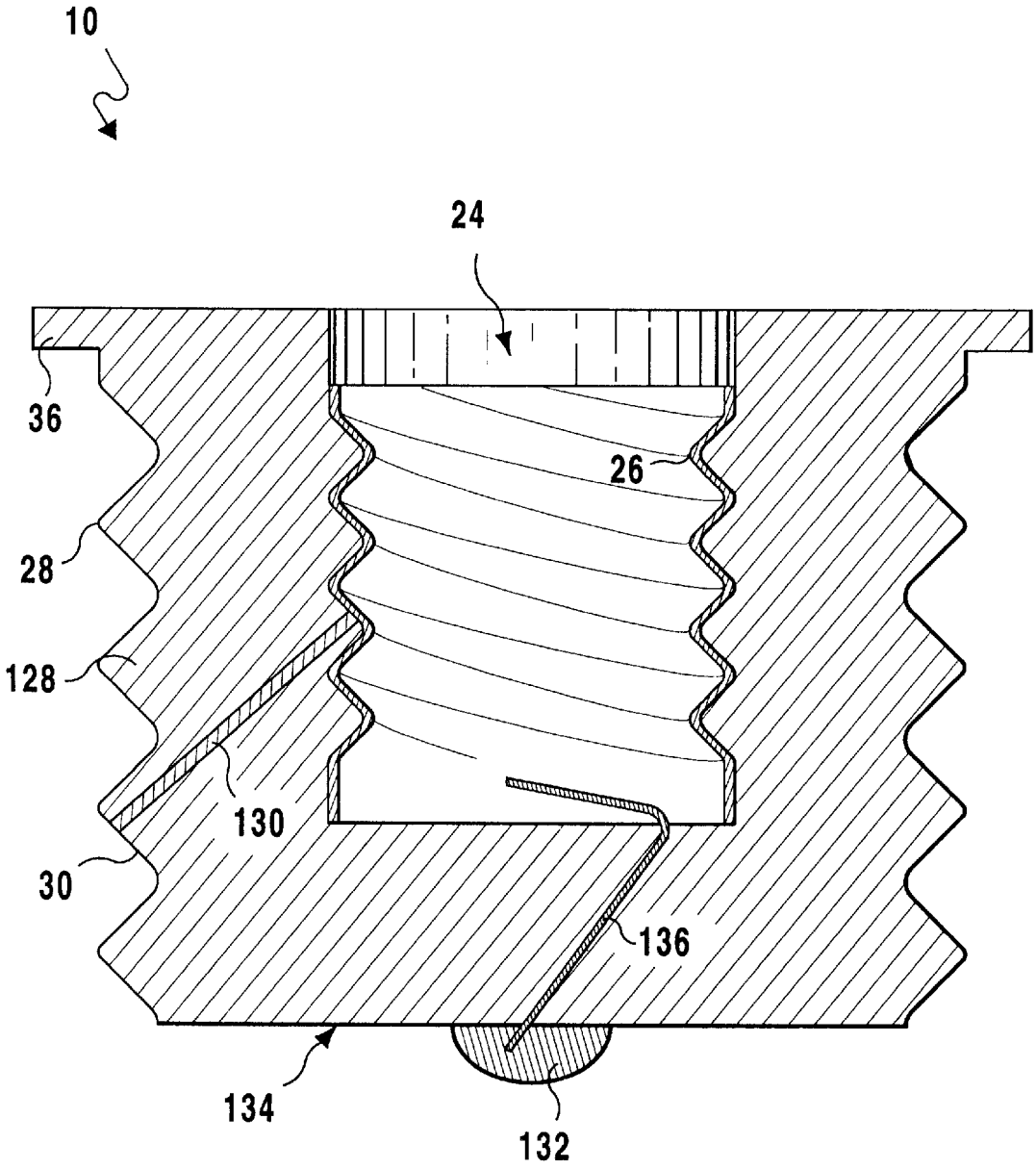
FIG. 6 is a cross-sectional view of the power level adapter for high power level electrical lighting fixtures of the present invention taken along the line 6—6 of FIG. 2.

FIG. 6 illustrates a cross-sectional view of the first embodiment of the power level adapter 10. As can be seen from this figure, the first embodiment of the power level adapter 10 includes the collar 36 having a skirt 128 depending therefrom. The skirt 128 is defined by the outer side 30 having the thread 28 spiraling therearound for mating with a thread on an inner side of an Edison type socket and the inner side 24 including the thread 26 spiraling therearound for mating with a thread on an Edison type light bulb. The inner side 24 is formed of an electrically conductive material and forms a pool for receiving the base of the Edison type bulb therein. The base side of the pool is made of a nonconductive material. The first embodiment of the power level adapter 10 is preferably made of a non conductive material and includes a first electrically conductive coupling wire 130 extending from the outer side 30 and through the skirt 128 to the inner side 24. This coupling wire 130 connects a first pole of the Edison type socket to a first pole of the Edison type light bulb. A contact terminal 132 is positioned on a base side 134 of the skirt 128. A second electrically conductive coupling wire 136 is connected to the contact terminal 132 and extends from the base 134 and through the skirt 128 and into the pool. The second coupling wire 136 connects a second pole of the Edison type socket to a second pole of the Edison type light bulb. A path for current to flow to the low power Edison type light bulb is thus established by the first and second coupling wires 130 and 136, respectively, allowing the Edison type light bulb to illuminate.

Figure 7:
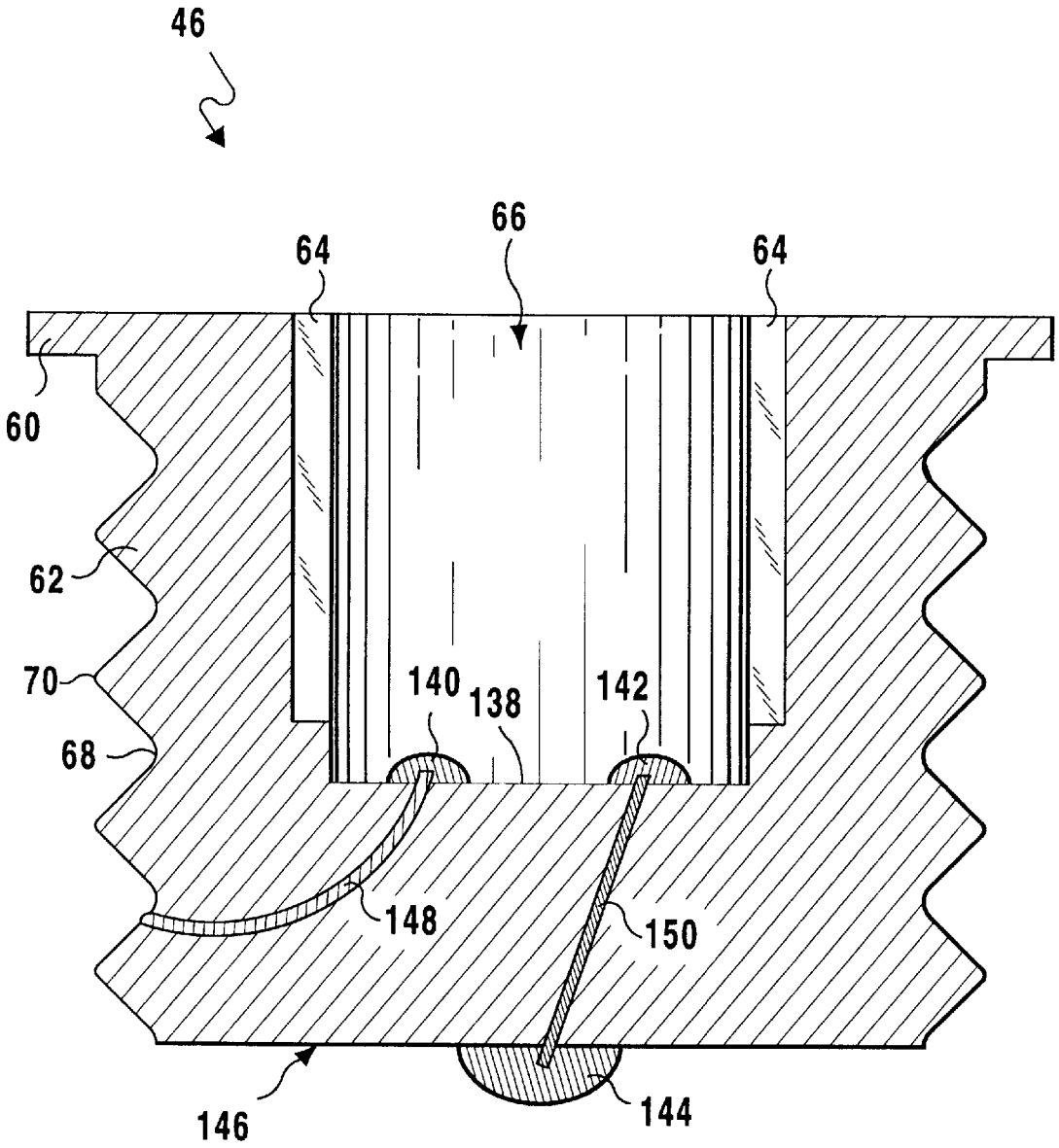
FIG. 7 is a cross-sectional view of the power level adapter for high power level electrical lighting fixtures of the present invention taken along the line 7—7 of FIG. 3.

FIG. 7 illustrates a cross-sectional view of the second embodiment of the power level adapter 46. As can be seen from this figure, the second embodiment of the power level adapter 46 includes the collar 60 having the skirt 62 depending therefrom. The skirt 62 is defined by the outer side 68 having the thread 70 spiraling therearound for mating with a thread on an inner side of an Edison type socket. The skirt 62 is further defined by the inner side 66 including a pair of L-shaped recesses 64 extending therealong. The L-shaped recesses 64 are sized for receiving a pair of pins extending from a base of a Bayonet type light bulb. The inner side 66 forms a pool for receiving the base of the Bayonet type light bulb. On a base side 138 of the pool are positioned first and second contact terminals 140 and 142 respectively. The first and second recesses 140 and 142 contact first and second contacts on a base of the Bayonet type light bulb when the light bulb is received within the pool. A third contact terminal 144 is positioned on a base side 146 of the skirt. The third contact terminal 144 will contact a terminal at the base of the Edison type socket when received therein. A first electrically conductive coupling wire 148 extends from the outer side 68 and through the skirt 62 to the first contact terminal 140. This coupling wire 148 connects a first pole of the Edison type socket to the first contact terminal 140. A second electrically conductive coupling wire 150 extends from the third contact terminal 144 on the base side 146, through the skirt 62 to the second contact terminal 142 on the inner side 66. This coupling wire 150 connects the third contact terminal 144 to the second contact terminal 142. A path for current to flow to the low power Bayonet type light bulb is thus established by the first and second coupling wires 148 and 150, respectively, allowing the Bayonet type light bulb to illuminate.

FIG. 8 illustrates a cross-sectional view of the third embodiment of the power level adapter 80. As can be seen from this figure, the third embodiment of the power level adapter 80 includes a collar 87 having the skirt 88 depending therefrom. The skirt 88 is defined by the outer side 88 including the base side 92 having first and second contact terminals 152 and 154, respectively, positioned thereon for contacting first and second contact terminals within the Bayonet type socket. The skirt 88 is further defined by the inner side 86 including the thread 84 spiraling therearound for mating with a thread on an Edison type light bulb. The inner side 24 is formed of an electrically conductive material and forms a pool for receiving the base of the Edison type bulb therein. The base side of the pool is made of a nonconductive material. The third embodiment of the power level adapter 80 is preferably made of a non conductive material and includes a first electrically conductive coupling wire 156 extending from the first contact terminal 152 and through the skirt 88 to the conductive material forming the inner side 86 and a second electrically conductive coupling wire 158 extending from the second contact terminal 154, through the skirt 88, through the base side and into the pool. The first coupling wire 156 connects the first pole of the Bayonet type socket to a first pole of the Edison type light bulb and the second coupling wire 158 connects the second pole of the Bayonet type socket to a second pole of the Edison type light bulb.

Figure 9:
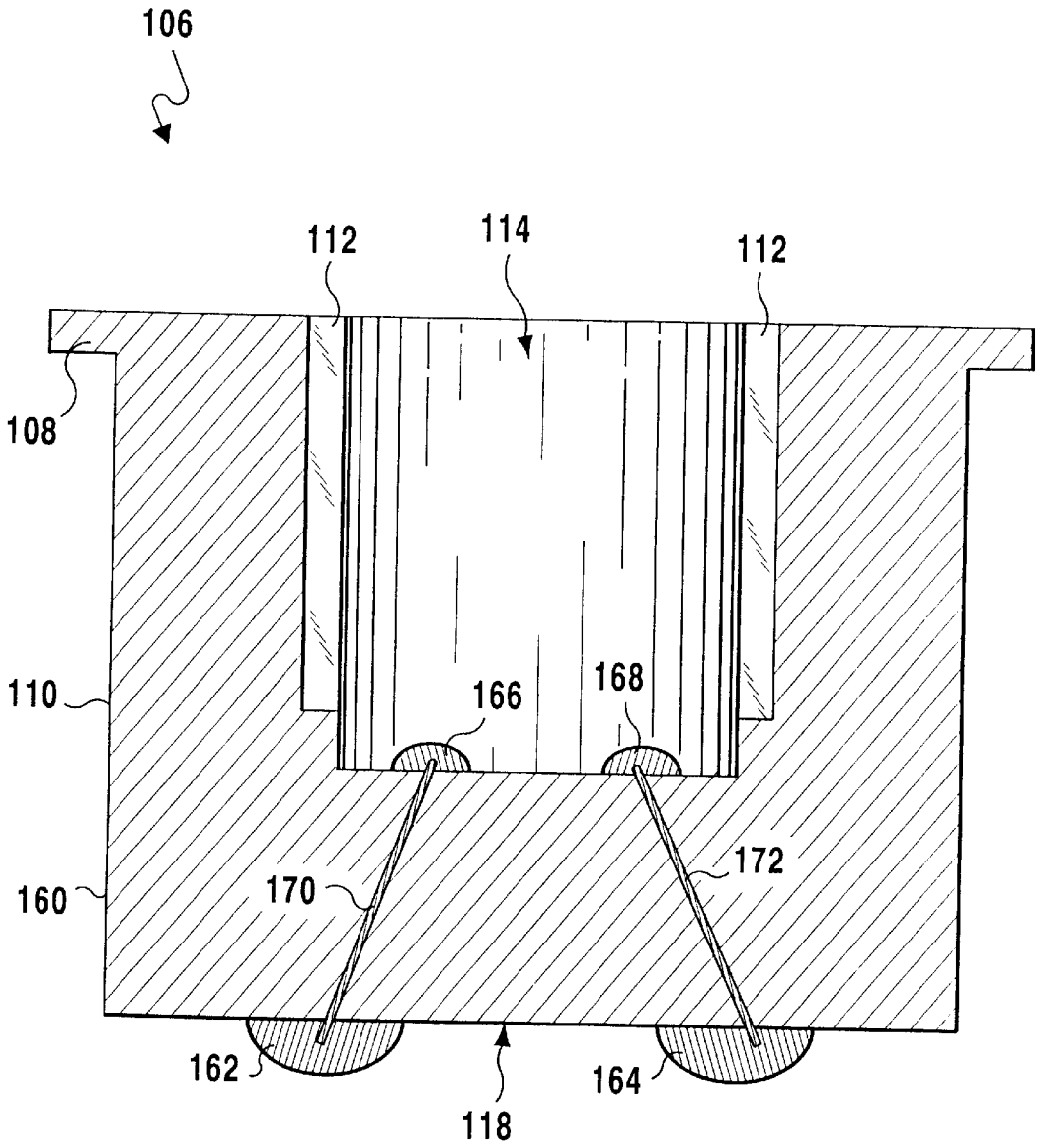
FIG. 9 is a cross-sectional view of the power level adapter for high power level electrical lighting fixtures of the present invention taken along the line 9—9 of FIG. 5.

FIG. 9 illustrates a cross-sectional view of the fourth embodiment of the power level adapter 106. As can be seen from this figure, the fourth embodiment of the power level adapter 106 includes the collar 108 having the skirt 110 depending therefrom. The skirt 88 is defined by an outer side 160 and the base side 92 having first and second contact terminals 162 and 164, respectively, positioned thereon for contacting first and second contact terminals within the Bayonet type socket. The skirt 110 is further defined by the inner side 114 including third and fourth contact terminals 166 and 168 therein for mating with the contact terminals on the base of the Bayonet type light bulb. The fourth embodiment of the power level adapter 106 is preferably made of a non conductive material and includes a first electrically conductive coupling wire 170 extending from the first contact terminal 162 and through the skirt 110 to the third contact terminal 166 and a second electrically conductive coupling wire 172 extending from the second contact terminal 164, through the skirt 88 to the fourth contact terminal 168. The first coupling wire 170 connects the first pole of the Bayonet type socket to a first pole of the Bayonet type light bulb and the second coupling wire 172 connects the second pole of the Bayonet type socket to a second pole of the Bayonet type light bulb.

Figure 10:
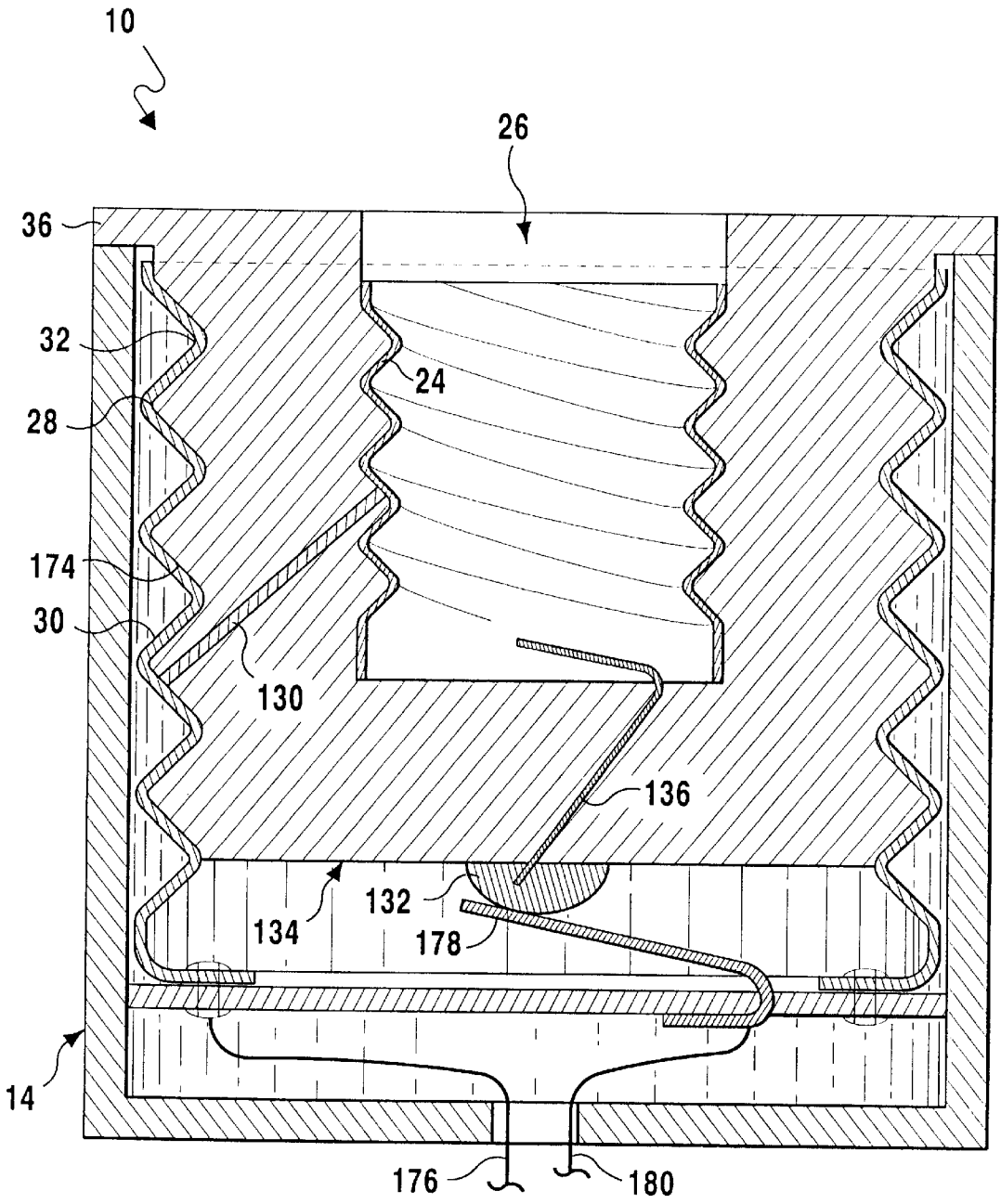
FIG. 10 is a cross-sectional view of the power level adapter for high power level electrical lighting fixtures of the present invention and socket taken along the line 10—10 of FIG. 2.

FIG. 10 illustrates a cross-sectional view of the first embodiment of the power level adapter 10 positioned within an Edison type socket 18. From this view the connections between the poles of the Edison type socket and the first embodiment of the power level adapter 10 are clearly seen. The Edison type socket 14 includes an inner side 174 made of electrically conductive material connected to a ground wire 176 and a pole 178 extending therein connected to a source of positive voltage 180. The electrically conductive inner side 174 is coupled to the electrically conductive material on the inner side of the power level adapter 10 for ultimate connection to the Edison type light bulb. The pole 178 is coupled to the contact terminal 132 on the base of the power level adapter 10 when received therein for supplying a current to the pole on the Edison type light bulb via the second coupling wire 136.

Figure 11:
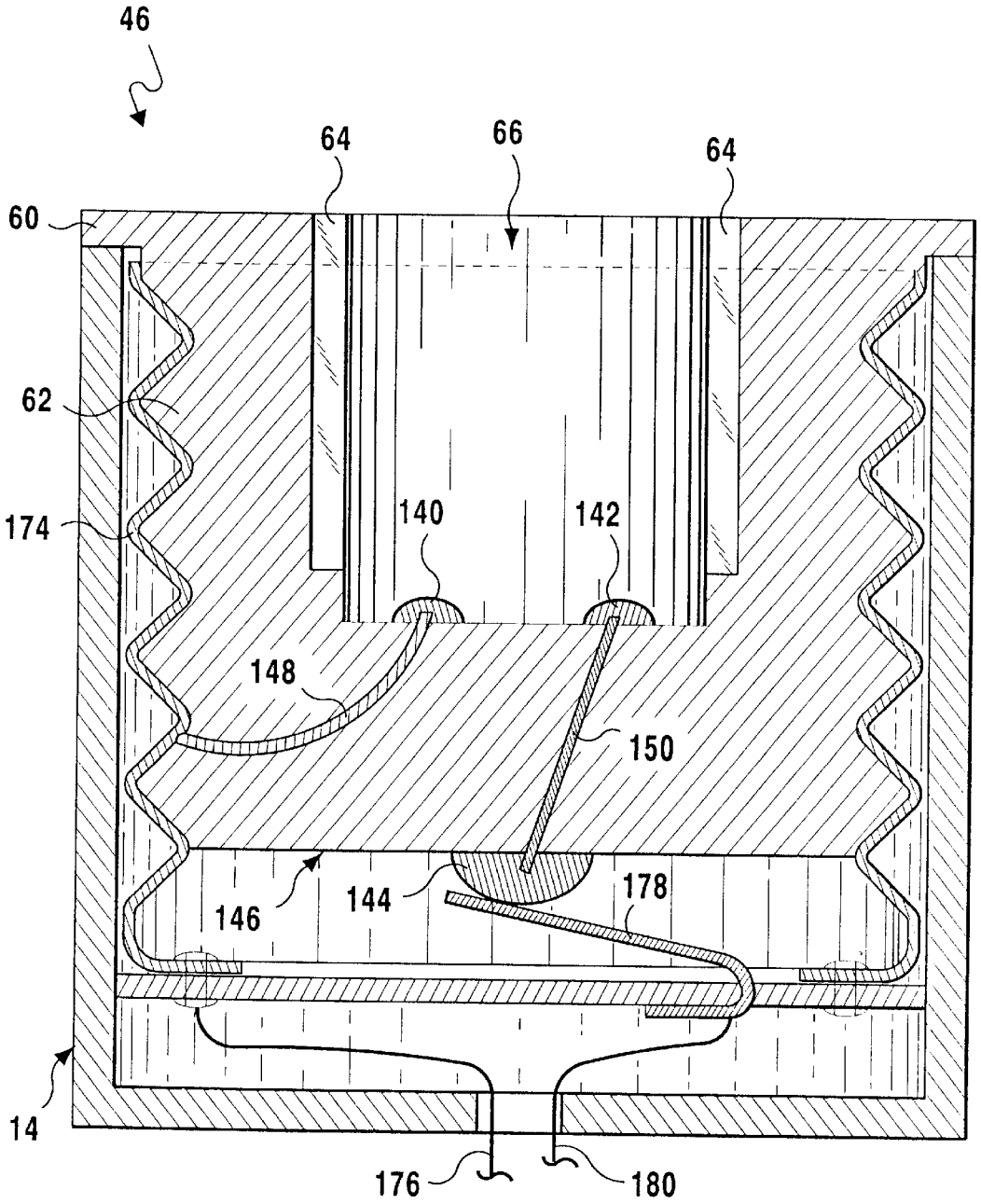
FIG. 11 is a cross-sectional view of the power level adapter for high power level electrical lighting fixtures of the present invention and socket taken along the line 11—11 of FIG. 3.

FIG. 11 illustrates a cross-sectional view of the second embodiment of the power level adapter 46 positioned within an Edison type socket 14. From this view the connections between the poles of the Edison type socket 14 and the second embodiment of the power level adapter 46 are clearly seen. When the power level adapter 46 is positioned within an Edison type socket 14 the first coupling wire 148 couples the electrically conductive side 174 of the Edison type socket 14 to the first contact terminal 140 of the power level adapter 46 and the second coupling wire 150 connects the pole 178 of the Edison type socket 14 to the second contact terminal 142 of the power level adapter 46. Theses connections supply a current to the Bayonet type light bulb allowing it to illuminate when received when received by the power level adapter 46.

FIG. 12 illustrates a cross-sectional view of the third embodiment of the power level adapter 80 positioned within a Bayonet type socket 18. The Bayonet type socket 82 includes a first contact terminal 182 connected to a ground wire 184 and a second contact terminal 186 connected to a voltage supply 188. When the power level adapter 80 is positioned within the Bayonet type socket 82, the first terminal 152 on the base side 92 of the power level adapter 80 contacts the first contact terminal 182 within the Bayonet type socket 82 and the second terminal 154 on the base side 92 of the power level adapter 80 contacts the second contact terminal 186 within the Bayonet type socket 82. When an Edison type light bulb is positioned within the power level adapter 80 a connection is established between the first contact terminal 182 within the Bayonet type socket 82 and the first pole of the Edison type light bulb via the first terminal 152 and the first coupling wire 156 and a second connection is established between the second contact terminal 186 within the Bayonet type socket 82 and the second pole of the Edison type light bulb via the second terminal 154 and the second coupling wire 158.

Figure 13:
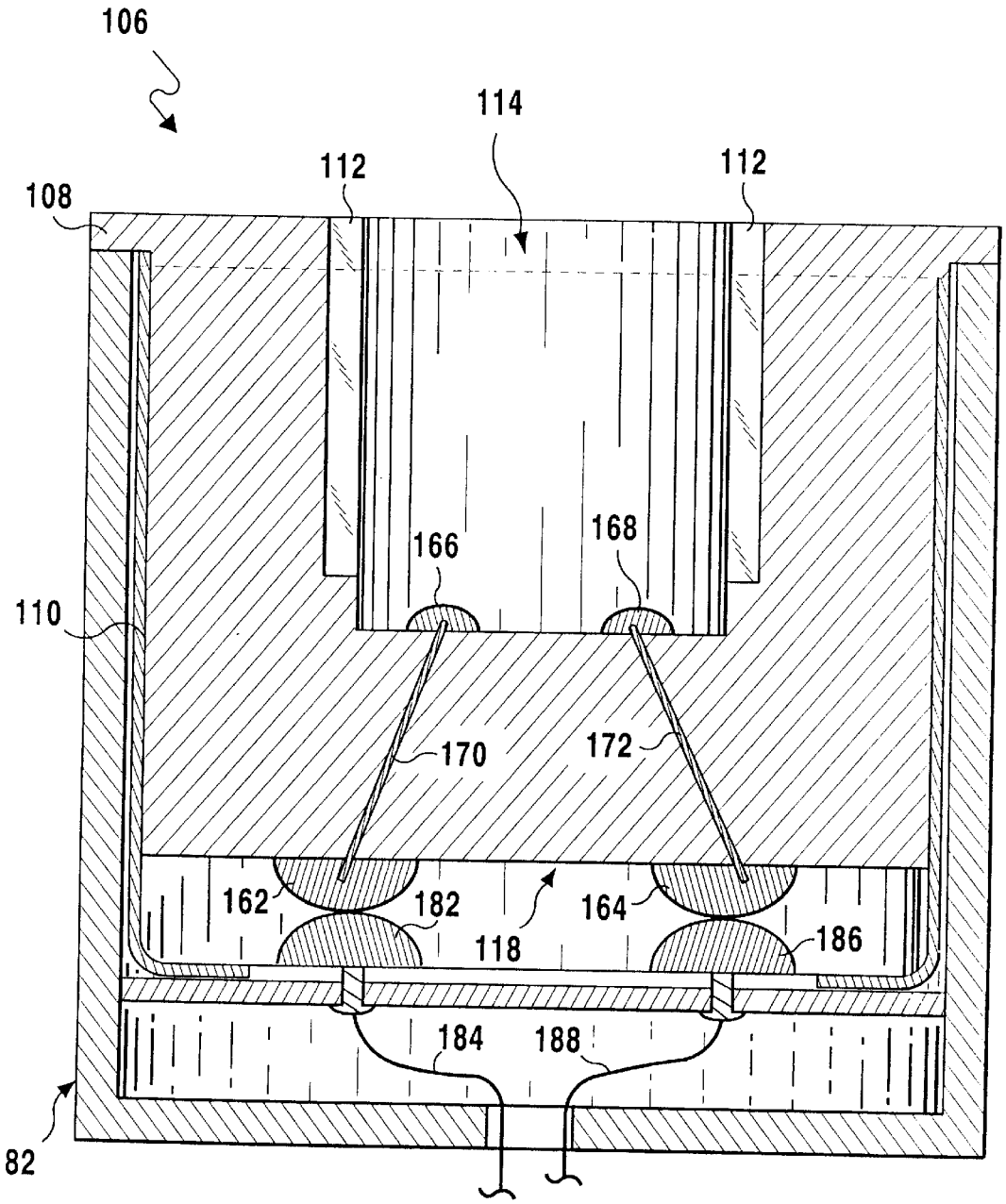
FIG. 13 is a cross-sectional view of the power level adapter for high power level electrical lighting fixtures of the present invention and socket taken along the line 13—13 of FIG. 5.

FIG. 13 illustrates a cross-sectional view of the fourth embodiment of the power level adapter 106 positioned within a Bayonet type socket 82. When the power level adapter 106 is positioned within the Bayonet type socket 82, the first terminal 162 on the base side 118 of the power level adapter 106 contacts the first contact terminal 182 within the Bayonet type socket 82 and the second terminal 164 on the base side 118 of the power level adapter 106 contacts the second contact terminal 186 within the Bayonet type socket 82. When a Bayonet type light bulb is positioned within the power level adapter 106 a first connection is established between the first contact terminal 182 within the Bayonet type socket 82 and the first pole of the Bayonet type light bulb via the first terminal 162, the first coupling wire 170 and the third terminal 166. A second connection is established between the second contact terminal 186 within the Bayonet type socket 82 and the second pole of the Bayonet type light bulb via the second terminal 164, the second coupling wire 172 and the fourth contact terminal 168.

The operation of the power level adapter will now be described with reference to the figures. In operation, the base of the low power light bulb 18 or 48 is inserted into the pool formed by the inner side of the power level adapter. If an Edison type light bulb is being used, the power level adapters of FIGS. 2 or 3 is used and if a Bayonet type light bulb is being used the power level adapter of FIGS. 3 or 4 is used.

When using the power level adapters of FIGS. 2 or 3 the power level adapter is grasped by the user about the collar and the light bulb is positioned above the pool formed by the inner side. While exerting a force on the light bulb towards the power level adapter, the light bulb is turned in a clockwise direction. This causes the thread spiraling around the inner side of the power level adapter to engage and mate with the thread spiraling around the base of the Edison type light bulb. When the threads are completely mated whereby the base of the light bulb is fully received within the pool, the contact terminals of the light bulb are in contact with the contact terminals within the bulb receiving pool.

If the power level adapters of FIGS. 4 or 5 are used, the power level adapter is grasped by the user about the collar and a bayonet type light bulb is positioned such that the pins extending from the base of the bayonet type light bulb are aligned with and received by respective ones of the L-shaped recesses in the skirt of the power level adapter. This allows the base of the bayonet type light bulb to be received within the bulb receiving pool of the power level adapter. The bayonet type light bulb is then turned in a counterclockwise direction causing the pins extending from the base to be received by the horizontal section of their respective L-shaped recess in the inner side of the power level adapter. The two contact terminals on the underside of the base are now placed in contact with the first and second contact terminals within the bulb receiving pool of the power level adapter.

The next step is to connect the power level adapter within the desired socket. If an Edison type socket is used, the power level adapter of FIGS. 2 or 4 are used, and if a Bayonet type socket is used, the power level adapter of FIGS. 3 or 5 are used.

When using the power level adapters of FIGS. 2 or 4 the power level adapter is grasped by the user about the collar and is positioned above the pool formed by the inner side of the Edison type socket. While exerting a force on the power level adapter towards the socket, the power level adapter is turned in a clockwise direction. This causes the thread spiraling around the inner side of the power level adapter to engage and mate with the thread spiraling around the base of the Edison type socket. When the threads are completely mated whereby the base of the power level adapter is fully received within the socket, the contact terminals of the power level adapter are in contact with the contact terminals within the socket. This forms an electrical connection between the contact terminals within the socket and the contact terminals of the light bulb through the power level adapter.

If the power level adapters of FIGS. 3 or 5 are used, the power level adapter is grasped by the user about the collar and is positioned such that the pins extending from the base of the power level adapter are aligned with and received by respective ones of the L-shaped recesses in the socket. This allows the base of the power level adapter to be received within the bulb receiving pool of the socket. The power level adapter is then turned in a counterclockwise direction causing the pins extending from the base to be received by the horizontal section of their respective L-shaped recess in the inner side of the socket. The two contact terminals on the underside of the base are now placed in contact with the first and second contact terminals within the socket. This forms an electrical connection between the contact terminals within the socket and the contact terminals of the light bulb through the power level adapter.

Once connected, the light bulb is electrically connected to the source of power supplied through the socket and is operational to illuminate at the discretion of the user.

From the above description it can be seen that the light bulb-socket adapter of the present invention is able to overcome the shortcomings of prior art devices by providing a power level adapter for high power level electrical lighting fixtures which allows use of a low power light bulb in a fixture designed to receive higher power light bulbs. The power level adapter includes a nonconductive collar allowing gripping of the adapter for installation and removal of the electrical lamp lighting fixture bulb adapter, electrically conductive contact points for mating with the electrically conductive contacts within the socket of the fixture and a substantially nonconductive exterior surface for protecting a user from defective sockets and inadvertent contact with any electrically conductive components of the socket and/or adapter. The power level adapter is designed to be substantially contained within the socket of the fixture by which it is received thereby providing an ergonomically functional adapter for use in highly visible locations and is able to effectively reduce the circumference of the socket for receiving lower power light bulbs having a base of a circumference smaller than that of the socket. The power level adapter allows installation of a candelabra type light bulb having an Edison type base into a standard Edison type base, a candelabra type light bulb having a Bayonet type base into a standard Edison type socket, a candelabra type light bulb having an Edison type base into a standard Bayonet type socket base and a candelabra type light bulb having a Bayonet type base into a standard Bayonet type socket. The power level adapter also allows both the use of smaller wattage bulbs with a high wattage fixture and the permanent use of smaller wattage bulbs with a high wattage fixture thereby reducing energy costs. Furthermore, the power level adapter of the present invention is simple and easy to use and economical in cost to manufacture.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A lighting fixture having first and second higher power, threaded electrical sockets for accommodating a low power light bulb and a higher power light bulb within said lighting fixture comprising:

a) an adapter threaded in the first of said sockets to receive said low power light bulb;

b) said adapter comprising a collar, a skirt depending from said collar and including a threaded outer side having a circumference substantially equal to a circumference of the first higher power socket, an inner side extending through said collar and forming a bayonet type socket to receive a bayonet type base of a low power light bulb, and a base side having first and second electrical contacts positioned atop said base side; and c) means extending through said skirt for electrically connecting said first and second electrical contacts to said first higher power socket.

* * * * *